United States Patent [19]

Kirilloff et al.

[11] Patent Number: 5,049,851

[45] Date of Patent: Sep. 17, 1991

[54] EMBOSSED AND LANCED RESISTOR STRUCTURE

[75] Inventors: Victor V. Kirilloff, Lincoln, Nebr.; Robert Cummins; William A. Benson, both of Pittsburgh, Pa.

[73] Assignee: Mosebach Manufacturing Company, Pittsburgh, Pa.

[21] Appl. No.: 465,390

[22] Filed: Jan. 16, 1990

[51] Int. Cl.[5] ..... H01C 3/00

[52] U.S. Cl. ..... 338/280; 338/277; 338/281; 338/283

[58] Field of Search ..... 338/277–295; 219/539, 542

[56] References Cited

U.S. PATENT DOCUMENTS

| | | | |
|---|---|---|---|
| 2,680,178 | 6/1954 | Kuhn et al. | 201/69 |
| 2,721,920 | 10/1955 | Weide | 338/295 X |
| 2,772,337 | 11/1956 | Du Bois | 201/69 |
| 2,891,303 | 6/1959 | Stevenson | 338/295 X |
| 3,027,532 | 3/1962 | Du Bois | 338/280 |
| 4,651,125 | 3/1987 | Harkness | 338/295 |

*Primary Examiner*—Marvin M. Lateef

*Attorney, Agent, or Firm*—Buchanan Ingersoll

[57] ABSTRACT

A resistor grid for dynamic braking and the like has a fan-folded strip of resistance material mounted in a frame. The strip is embossed longitudinally so as to stiffen it between folds or loops and lanced or slit longitudinally between embossments from fold to fold but not around folds.

7 Claims, 3 Drawing Sheets

EMBOSSED AND LANCED RESISTOR STRUCTURE

This invention relates to an improvement in frame supported resistor grids suitable for use in electrically driven locomotives and cars as dynamic braking resistors. It is more particularly concerned with such resistors in which the resistance strip migration or displacement caused by heat and vibration is reduced. Frame supported resistor grids of one type generally used prior to our invention disclosed hereinafter are shown in Kirilloff et al. U.S. Pat. No. 4,837,549. The resistor ribbon is fan-folded and may be arranged in several columns aligned edge-to-edge, as is shown in FIGS. 2 and 8 of that patent. The mounting flanges of said grids are positioned to be attached to horizontal support bars in ladder-like arrangement so as to tilt the resistor ribbon from front to back by about 45 degrees. The width of the ribbon has conventionally been limited to around 2" or so as wider ribbon, when heated, has more of a tendency to twist. In the resistor grids so mounted a loop of sagging or twisted resistor ribbon may make contact with a loop lying below it, thus shorting part of the resistance array. Various attempts have been made to stiffen the resistor strip by embossing that portion of the ribbon between successive loops.

SUMMARY OF THE INVENTION

We have found that sagging and distortion of the resistor element above mentioned can be considerably reduced by a form of embossing combined with lancing or slitting the ribbon longitudinally between loops but not around the loops. Resistor strips so formed can be assembled in a single frame if they are embossed as will be described hereinafter and lanced as above described into multiple narrow widths. For example, a 6" wide resistor strip can be lanced into three 2" wide strips over that portion of its length which is between loops and each 2" wide portion embossed between the lanced slits so as to provide a resistor unit which is less prone to sag and distort than a single 2" resistor strip conventionally embossed.

In the past resistor units as above described have been made up of several narrow resistor strips 2" wide mounted edge to edge. If one fold of such a strip slips out of its holder, that fold, having no support, may fall against an adjoining resistor strip, causing a short. This cannot happen in our resistor unit to be described hereinafter, as the slits between the strips do not extend to the loop or fold at either end, which is the full width of the multiple section.

We find that our lanced and embossed multiple resistor units tend to run cooler than the same number of individual units of the same widths as one of our multiples. It appears that twisting or distortion of the portion between the slits caused by heating opens the slits somewhat, thus allowing air to pass through. This action in turn reduces the temperature of the hot portion causing the slit to close so that our resistor strip is to some degree self-compensating.

DESCRIPTION OF PREFERRED EMBODIMENT

Figure 1:
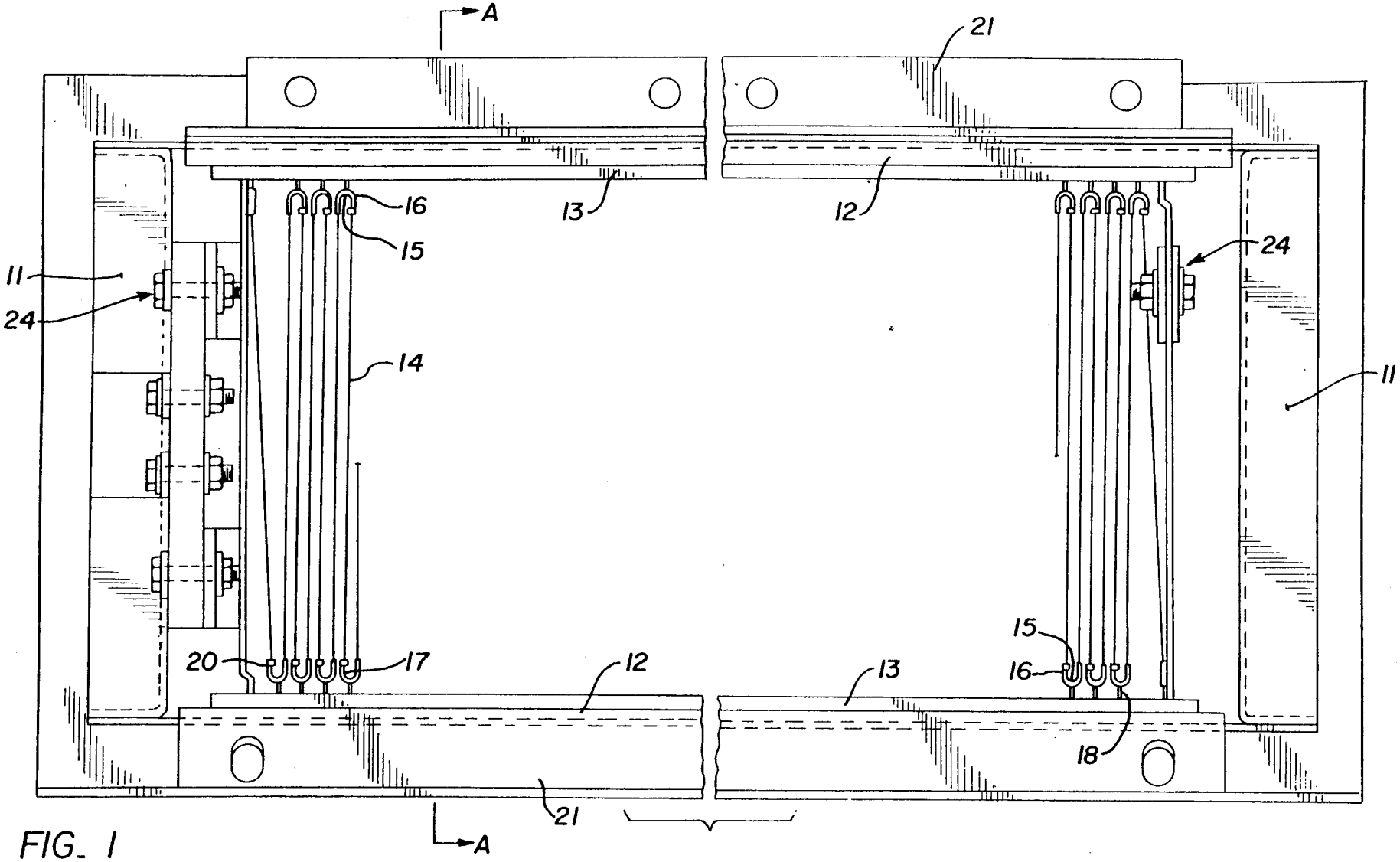
FIG. 1 is a plan of a resistor unit of our invention taken on a plane at 45° to the horizontal with the resistor strip shown schematically.
Figure 2:
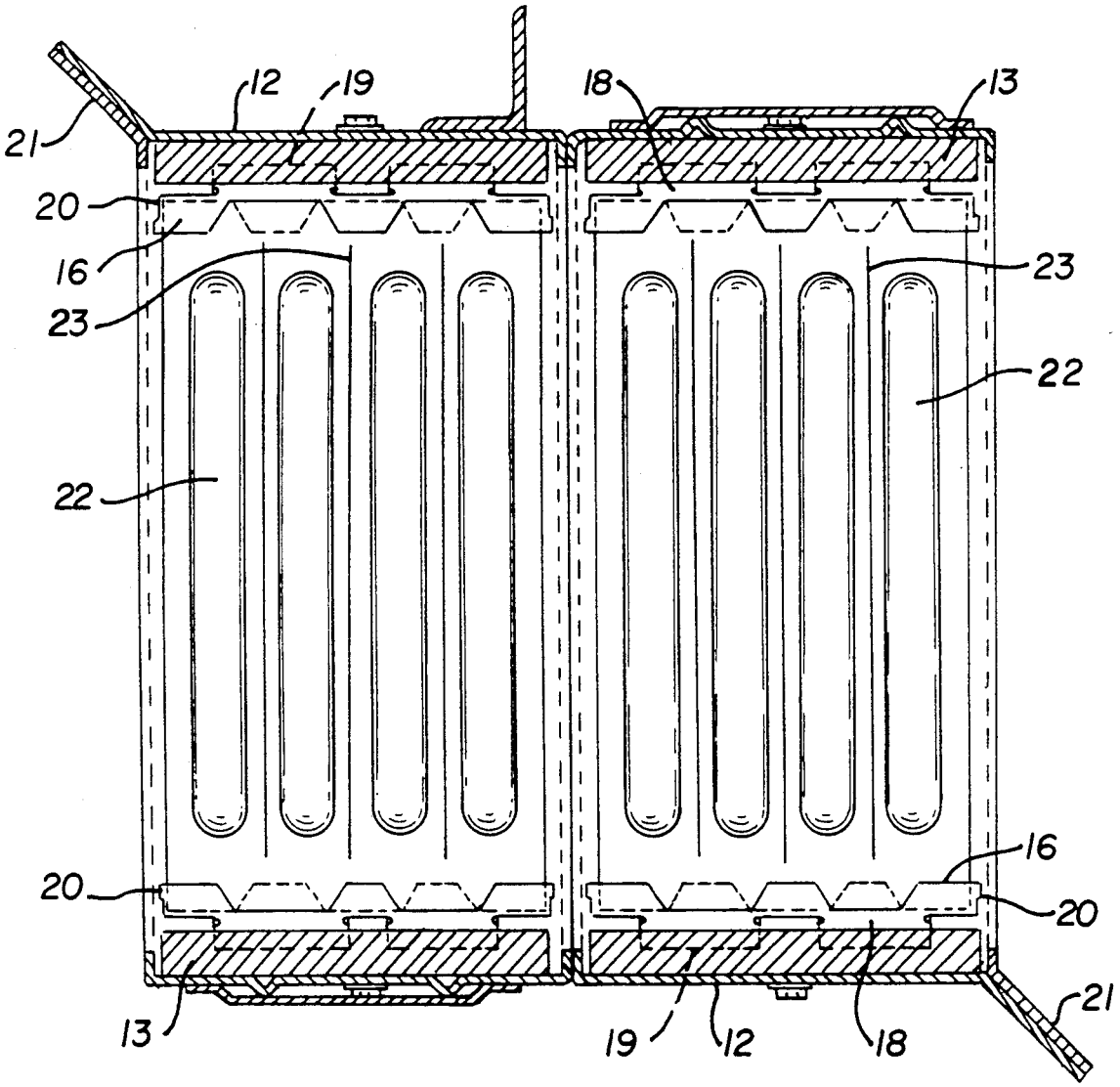
FIG. 2 is a section through the unit of FIG. 1 taken on the plane A—A therefor showing one form of embossment.

Our resistor unit is contained in a box-like frame having two metal end elements 11—11 and two side elements 12—12. At opposite corners of end elements 11 and side elements 12 are mounting flanges 21, inclined at 45° to the planes of ends 11 and sides 12. Each side element 12 supports a strip 13 of insulating material. The strip of resistor, designated generally as 14, is fan-folded between those insulating strips 13 filling the space between end elements 11. The strip 14 is supported from insulating strips 13 at each fold on a loop 15 by a metal clip 16 which, as is shown in FIG. 2, extends beyond the width of the resistor strip 14. Clip 16 is bent or curved at its open end to form a channel 17 of a slightly greater radius than the fold or loop 15 of resistor strip 14 and has a projection 18 at its closed end which fits into a groove or other opening 19 in insulating strip 17. As is shown in FIG. 2, neither the projection 18 nor the groove 19 need be continuous. At each outside end of clip 16, channel element 17 has an inwardly folded tab 20 which prevents resistor ribbon 14 from sliding along and out of channel 17. Ribbon 14 at each end is attached to a terminal 24.

Our resistor ribbon 14 is embossed to stiffen it. In FIG. 2, which shows two resistor units mounted together, the ribbon 14 in each unit is embossed longitudinally in a four parallel channel pattern 22, the channels being spaced from each other across the width of the strip and extending over substantially all of each flight of ribbon between its folds 15 at each end. Between embossments 22 the strip is longitudinally lanced or slit as at 23 over a length not less than the length of the embossments but not extending into the folds 15 of the strip within clip 16.

Figure 3:
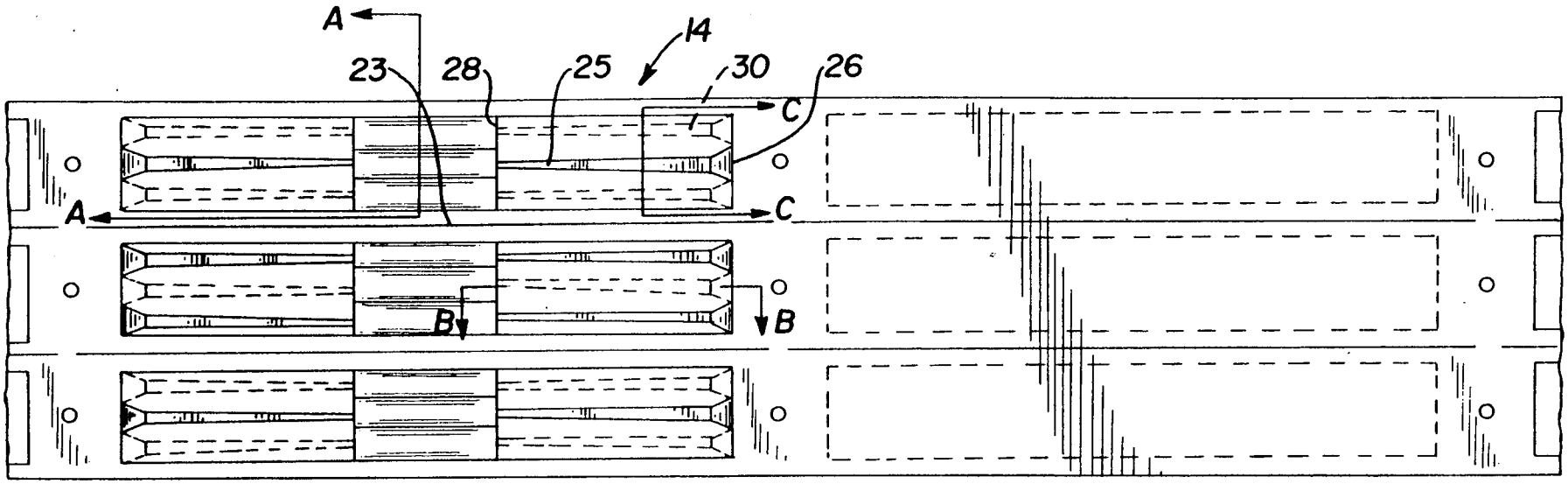
FIG. 3 is a plan of the portion of the resistor suitable for our invention showing another form of embossment.
Figure 6:
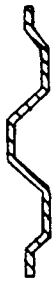
FIG. 6 is a section through FIG. 3 taken on the place C—C thereof.
Figure 5:
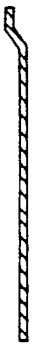
FIG. 5 is a section through FIG. 3 taken on the plane B—B thereof.
Figure 4:
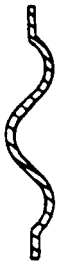
FIG. 4 is a section through FIG. 3 taken on the plane A—A thereof.

The embossments may take different forms. In FIG. 3 a length of strip 14 is shown with embossments 25 and 30 which are wider and deeper at their ends 26 near the portion forming the loops or folds 15 of a fan-folded strip and tapering at 28 to the flat ribbon 14 before reaching the mid part of the flight. Embossments 25 and 30 protrude alternately on opposite sides of strip 14 respectively. In FIG. 3 the embossments above mentioned are shown in three groups of three each, the groups being spaced from each other across the strip 14 and the embossments 25 and 30 in each group being spaced from each other. The strip 14 is lanced or slit longitudinally between adjoining groups of three embossments each to form slits 23 as before mentioned. Other forms of longitudinal embossment and other groupings of such embossments across wide strip may be employed together with lancing as described herein.

We have found that resistor grids formed as described hereinabove dissipate heat more effectively than conventional grids of the same size. It is our belief that when the resistor strip as herein described is heated the section of the strip between lancings deforms or twists so as to open the slits somewhat and permit cooling air to pass therethrough. We have also found that, if a section of strip between slits is heated to cause severe distortion, the flight will not fall out on a unit below it, as sometimes happens with conventional resistor grids. The strip has its full width at the fold and in addition the projection 20 prevents the fold or loop from sliding out of the clip.

We claim:

1. In a resistor grid comprising a rectangular frame enclosing adjoining columns of resistor ribbon fan-folded into parallel flights connected by end loops, and insulating means supporting said columns at their end loops from said frame, at least some of said flights being embossed to stiffen them, the improvement comprising at least one longitudinal slit in at least some of said flights extending intermediate said end loops less than the distance between said end loops of said flights, but severing said flights into at least two portions in the same plane over the greater extent of the lengths of said portions.

2. The resistor grid of claim 1 including two parallel slits severing said flights into three portions.

3. The resistor grid of claim 1 in which the insulating means supporting said columns at their end loops support them in unsevered resistor ribbon.

4. The resistor grid of claim 1 including said embossments in each severed portion.

5. The resistor grid of claim 4 in which adjoining embossments lie on opposite faces of said ribbon.

6. The resistor grid of claim 4 in which said embossments in each severed portion of a flight terminate short of the mid-point of each said portion.

7. The resistor grid of claim 6 in which said embossments are deeper near said end loops.

* * * * *